US007509763B1

(12) United States Patent
Alverson

(10) Patent No.: US 7,509,763 B1
(45) Date of Patent: Mar. 31, 2009

(54) INTERRELATED FORM APPARATUS AND METHOD

(76) Inventor: Carole Lynn Alverson, Two Portofino Dr., Suite 1902, Pensacola Beach, FL (US) 32561

( * ) Notice: Subject to any disclaimer, the term of this patent is extended or adjusted under 35 U.S.C. 154(b) by 0 days.

(21) Appl. No.: 11/999,833

(22) Filed: Dec. 7, 2007

(51) Int. Cl.
*G09F 7/00* (2006.01)

(52) U.S. Cl. ..... 40/605; 40/700; 40/743

(58) Field of Classification Search ..... 40/605, 40/700, 729, 743, 798, 738, 758
See application file for complete search history.

(56) References Cited

U.S. PATENT DOCUMENTS

| | | | | |
|---|---|---|---|---|
| 2,970,396 | A * | 2/1961 | Worrell | 40/605 |
| 5,890,309 | A * | 4/1999 | Markarian | 40/733 |
| 6,347,467 | B1 * | 2/2002 | Meyer | 40/124.06 |
| 6,421,942 | B1 * | 7/2002 | Galello | 40/738 |
| 6,729,060 | B1 * | 5/2004 | Rietkerk | 40/738 |
| 7,086,187 | B2 * | 8/2006 | Bandak | 40/453 |
| 2004/0128886 | A1 * | 7/2004 | Case | 40/605 |

OTHER PUBLICATIONS

"Coral Reef Scene," Artworks by Julia, http://web.archive.org/web/20060106212442/http://www.artworksbyjulia.com/_Commissioned/coral-reef.htm, Jan. 6, 2006.*
"Photo on Canvas," anthonyfineart.com, http://web.archive.org/web/20060219223616/http://www.anthonyfineart.com/picture+pages/ac+photo+on+canvas.html, Feb. 19, 2006.*
"Van Tuinen Art," http://www.vantuinenart.com/commissions.html, Dec. 1996.*
"Corner Paintings," Frank J. Malina, http://www.olats.org/pionniers/malina/arts/cornerPaintings.php, Dec. 1969.*

* cited by examiner

*Primary Examiner*—Gary C Hoge
(74) *Attorney, Agent, or Firm*—J. Nevin Shaffer, Jr.

(57) ABSTRACT

An interrelated form apparatus and method includes a three dimensional first piece with an image or partial image, with a front and a side. A three dimensional second piece with an image or partial image, with a front and a side is also provided. A first surface joined with a second surface at an angle is provided and the first piece is located on the first surface and the second piece is located on the second surface such that the image or partial image, on the front of one piece combines with the image or partial image, on the side of another piece to create a unified image. An unlimited number of pieces as well as surfaces as well as varying angles can be used to create the unified image.

20 Claims, 3 Drawing Sheets

INTERRELATED FORM APPARATUS AND METHOD

FIELD OF THE INVENTION

This invention relates to an interrelated form apparatus and method. In particular, in accordance with one embodiment, the invention relates, to an interrelated form apparatus including a three dimensional first piece with an image, with a front and a side. A three dimensional second piece with an image, with a front and a side is also provided. A first surface joined with a second surface at an angle is provided and the first piece is located on the first surface and the second piece is located on the second surface such that the image on the front of one piece combines with the image on the side of another piece to create a unified image.

BACKGROUND OF THE INVENTION

The creation and display of various forms has been the subject of interest to mankind since the dawn of time. By way of example only and not by limitation, paintings have been drawn directly on cave walls, church ceilings and sides of modern buildings. Images have been created on canvas, photographic paper and three dimensional pieces of art and hung on walls. It is the object of the presentation of these images to create a pleasing environment. One known attribute of a pleasing display is that the presentation is cohesive or consistent such that a contiguous theme is presented.

One problem with the way images are currently presented is that they are not amenable to a contiguous theme presentation other than on a single flat linear surface. That is, most images, art work such as paintings, for example only, are displayed on a wall as discrete images complete unto themselves and contained within the "frame" of painting. Corners thus provide a challenge to the artist should it be desired to continue a contiguous theme from one wall surface to an adjoining wall surface around a corner and beyond.

Another problem with images as currently created is that they are conformed to present an image on one piece, such as the front of a painting for example only, and one surface only. As a result, in order for one painting to relate to another painting so as to create a contiguous theme, it is necessary that the fronts be aligned on a surface since that is the only area in which the image is presented.

Thus, there is a need in the art for an apparatus and method for the presentation of images that create a contiguous theme when located on separate surfaces and that provides for the creation of a unified image by the combination of other than the front face of the images. It, therefore, is an object of this invention to provide an interrelated form that enables a user to present a contiguous theme by the combination of pieces on two or more surfaces that are joined together at an angle, such as for example, a corner or corners of a room. It is a further object of the invention to provide an interrelated form that creates a unified image by means of a combination of the front of one form with the side of another form, for example only and not by limitation.

SUMMARY OF THE INVENTION

Accordingly, an interrelated form apparatus, according to one embodiment of the invention, includes a three dimensional first piece with an image, with a front and a side. A three dimensional second piece with an image, with a front and a side is also provided. A first surface is joined with a second surface at an angle. The first piece is located on the first surface and the second piece is located on the second surface and the image on the front of one piece combines with the image on the side of another piece to create a unified image.

As used herein, the term "three dimensional" piece is used in its ordinary manner to describe an object with length, width and height or depth. Therefore, herein, the term "piece" may be any three dimensional object such as a painting or sculpture, by way of example only and not by way of limitation, or any other desirable object now known or hereafter developed.

Further, the term "image" is used in its ordinary manner to describe any image now known or hereafter developed such as, for example only again, a photograph, a painting, abstract images or designs, colors, or patterns displayed on a surface as one piece. Multiple separate or "partial images" may be combined to create a larger image. Thus, the term "partial image" is used in its ordinary manner to describe an image split between multiple pieces.

As used herein, the term "surface" is used to describe a flat linear or curvilinear display area such as, but not limited to, a wall.

Further, the term "unified image" is used in its ordinary manner to describe all partial images combined to make a whole complete image. That is, the flow of the image that is created is whole in the sense that the lines, image and colors are maintained one piece to another.

Further, the term "front" is used in its ordinary manner to describe the face of a piece.

Further, the term "side" is used in its ordinary manner to describe the depth edge of a three dimensional object, or piece.

Further, the term "top" is used in its ordinary manner to describe the upper side of a three dimensional object, or piece.

Further, the term "bottom" is used in its ordinary manner to describe the lower side of a three dimensional object, or piece.

In another aspect of this invention, a three dimensional third piece with an image, with a front and a side is provided and the third piece is located on one of the two surfaces and the image on the third piece combines with at least the first piece or the second piece to create the unified image. According to one aspect, the image on the third piece combines with both the first piece and the second piece to create the unified image.

In another aspect, a large number of three dimensional third pieces with an image, with a front and a side are provided and the third pieces are located on one of the surfaces and the images on the large number of third pieces combine with the first piece and the second piece to create the unified image. In one aspect a third surface is joined with at least the first surface or the second surface and the third piece is located on the third surface and yet combines to create a unified image.

According to another embodiment, an interrelated form apparatus includes a three dimensional first piece with a partial image, with a front, top, bottom and at least one side. A three dimensional second piece is also provided with a partial image, with a front, top, bottom and at least one side. A first surface is joined with a second surface at an angle and the first piece is located on the first surface and the second piece is located on the second surface such that the partial image on the front, top, bottom and at least one side of one piece combines with the partial image on the front, top, bottom and at least one side of another piece to create a unified image by the alignment of at least one of the following: front, top, bottom and at least one side of one piece with at least one of the following: front, top, bottom, and at least one side of another piece.

In another aspect, the partial image on the front, top, bottom and at least one side of one piece combines with the partial image on another piece to create a unified image along the front, the top, the bottom and the at least one side. In another aspect, a three dimensional third piece is provided with a partial image, with a front, top, bottom and at least one side such that, when the third piece is located on one of the surfaces, the partial image on the third piece combines with either the first piece or the second piece to create the unified image. In a further aspect, the partial image on the third piece combines with both the first piece and the second piece to create the unified image. In another aspect, a third surface is joined with either the first surface or the second surface and the third piece is located on the third surface. In one aspect, a large number of three dimensional third pieces are provided with a partial image, with a front, top, bottom and at least one side and the large number of third pieces are located on one of the surfaces such that the partial images on the third pieces combine with the first piece and the second piece to create the unified image.

According to other aspects of the invention, the unified image is made of material selected from the group consisting of: painted canvas, photographic prints, fabric, yarn, clay, metal and plastic. In another aspect, the first piece and the second piece are rectangular in shape with a front, top, bottom, and two sides. In another aspect, the first surface and the second surface are walls connected with each other at approximately ninety degrees. In one aspect, the unified image is selected from the group consisting of: pictures, graphics, colors and patterns.

According to another embodiment of the invention, a method for creating an interrelated form includes: providing a three dimensional first piece with an image, with a front and a side, a three dimensional second piece with an image, with a front and a side and a first surface joined with a second surface at an angle; and locating the first piece on the first surface and the second piece on the second surface such that the image on the front of one piece combines with the image on the side of another piece to create a unified image.

In another aspect, the method includes providing a three dimensional third piece with an image, with a front and a side and locating the third piece on one of the surfaces such that the image on the third piece combines with either the first piece or the second piece to create the unified image. In one aspect, locating the third piece causes the image on the third piece to combine with both the first piece and the second piece to create the unified image. In a further aspect, the method includes providing a large number of three dimensional third pieces with an image, with a front and a side and locating the third pieces on one of the surfaces such that the images on the third pieces combine with the first piece and the second piece to create the unified image. In another aspect, the method includes joining a third surface with either the first surface or the second surface and locating the third piece on the third surface.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
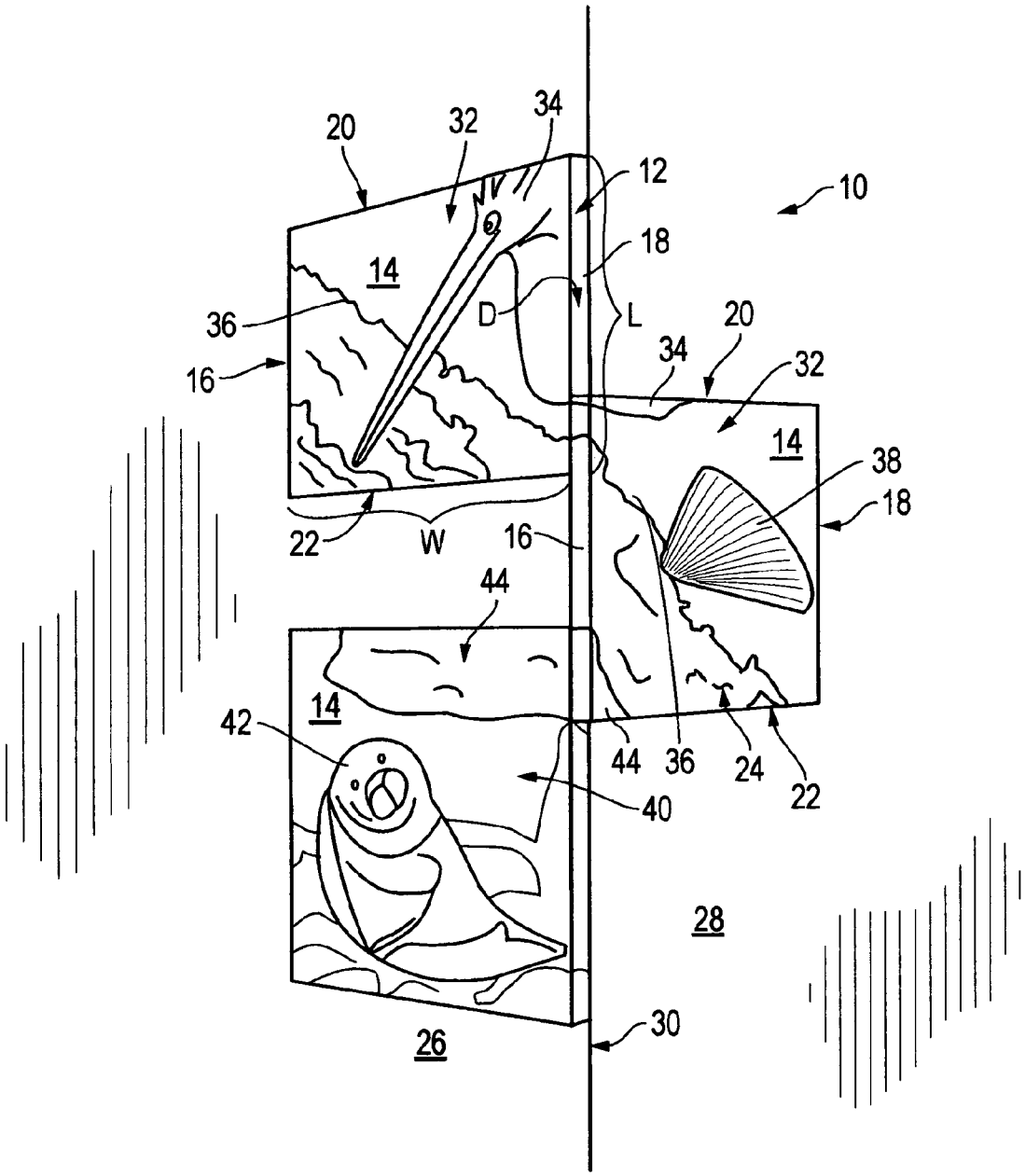
FIG. 1 is a perspective view of the interrelated form of the present invention according to one embodiment.
Figure 2:
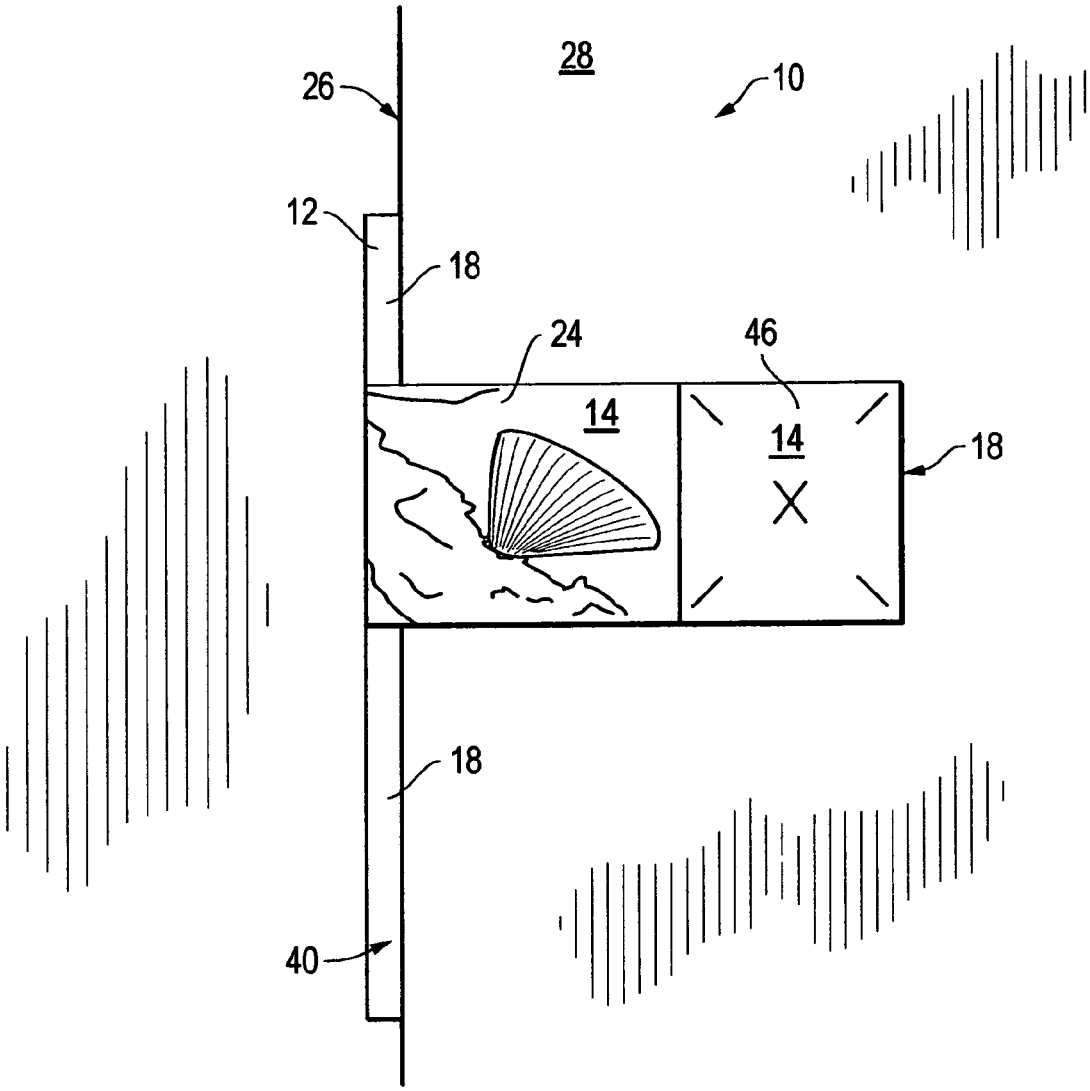
FIG. 2 is a right side view of the invention of FIG. 1.
Figure 3:
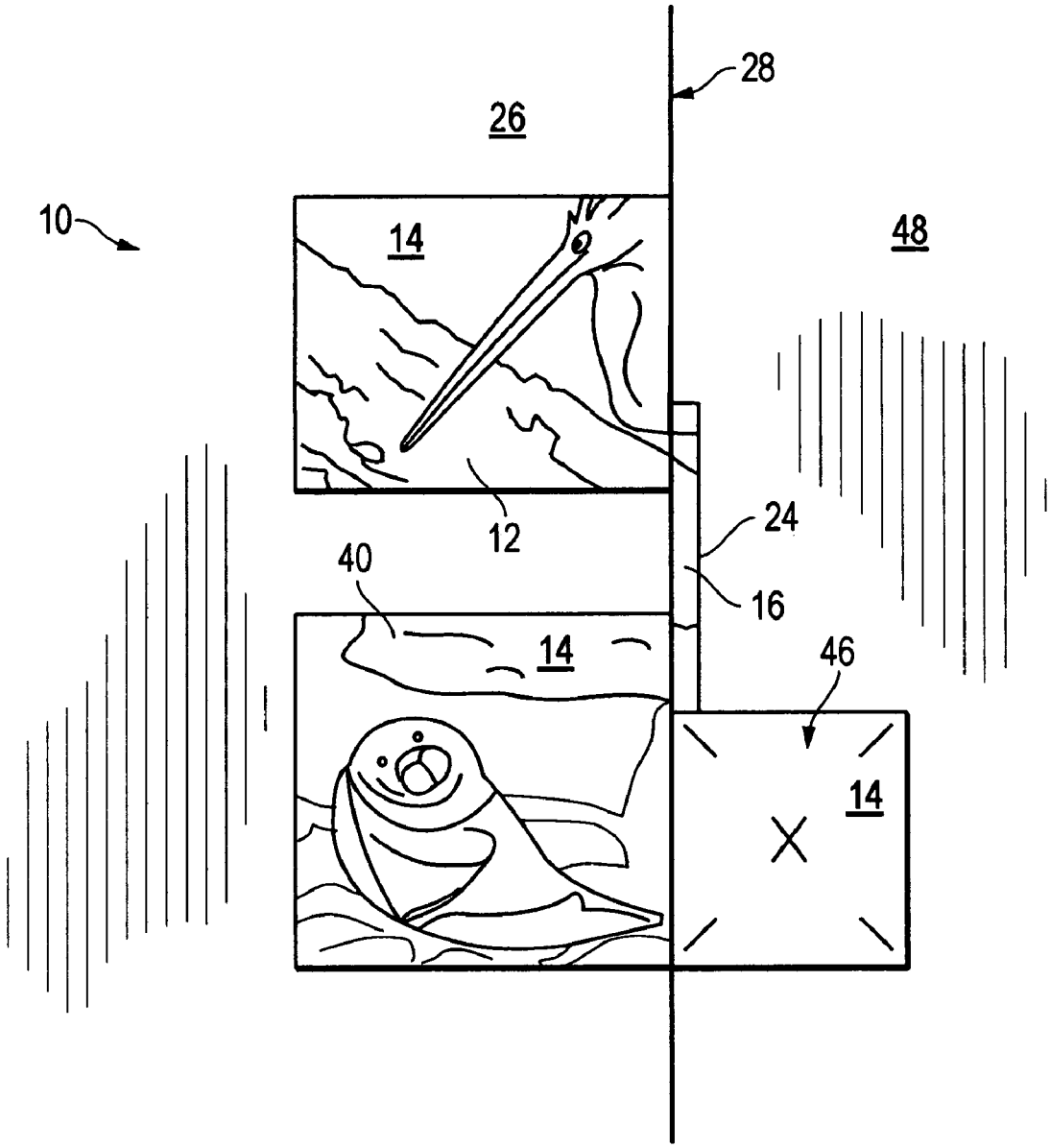
FIG. 3 is a left side view of the invention of FIG. 1.

The preferred embodiment of the present invention is illustrated by way of example in FIGS. 1-3. With specific reference to FIG. 1, interrelated form 10, according to one embodiment of the present invention, includes three dimensional first piece 12 with a front 14, left side 16, right side 18, top 20 and bottom 22. First piece 12 has a back (not shown) and is three dimensional in that it has a width "W", a length "L" and a depth "D".

FIG. 1 also illustrates three dimensional second piece 24 with a front 14, left side 16, right side 18, top 20 and bottom 22. Second piece 24 also has a back (not shown) and is also three dimensional in that it has a width "W", a length "L" and a depth "D".

FIG. 1 also shows first surface 26 connected at an angle with second surface 28. As shown, first surface 26 and a second surface 28 are walls connected at an angle of approximately ninety degrees so as to create a corner 30.

As illustrated in FIG. 1, first piece 12 and second piece 24 include an image 32. By way of example only, the image 32 on first piece 12 is of a bird 34 at a seashore 36. Image 32 on second piece 24 also includes a seashore 26 and a shell 38 and part of the bird 34. Thus, first piece 12 while an image in its own right is seen to be a partial image when placed in conjunction with second piece 24 in accordance with the invention. That is, importantly, the image 32 on the front 14 of first piece 12 combines with the image 32 on the left side 16 of second piece 24 to create a unified image. Thus, the seashore 26 flows from the front 14 of first piece 12 to the left side 16 of second piece 24 as a continuous and contiguous image and around corner 30 from first surface 26 to second surface 28.

FIG. 1 also illustrates another embodiment of the invention in which a three dimensional third piece 40 is located on first surface 26. The image 32 on third piece 40 is of a manatee 42 in deeper water 44 next to seashore 36. Here again, according to the invention, the front 14 of third piece 40 aligns with the left side 16 of second piece 24 to create a unified image in that deep water 44 on third piece 40 connects with, aligns with, the deep water 44 on the left side 16 of second piece 24 and transitions to the seashore 36. Thus, the right side 18 of first piece 12 is connected indirectly with and interrelated with third piece 40 through second piece 24 and together all three separate pieces present a unified image on two separate surfaces, 26 and 28, and around corner 30. This is true even though the first piece 12 and the third piece 40 are separated from each other on first surface 26 as illustrated.

Referring now to FIG. 2, another important aspect of the invention is illustrated in that when the interrelated form 10 is viewed from the right side with respect to FIG. 1, that is looking directly at second surface 28, the partial image 32 on the front 14 of second piece 24 forms a contiguous unified image with both the right side 18 of first piece 12 and the right side 18 of third piece 40.

FIG. 2 also illustrates another aspect of the invention in which another third piece 46 is located on second surface 28 and aligned with second piece 24. In this aspect, the image 32 may be extended and continued along the entire second surface 28 or any portion thereof using one or an unlimited number of other third pieces 46.

Referring now to FIG. 3, another aspect of the invention is shown in which the illustration of FIG. 1 is viewed from the left side looking directly at first surface 26. In this embodiment, a third surface 48, another wall, is connected at an acute angle, approximately ninety degrees, to second surface 28. Third surface 48 includes another third piece 46. As discussed above, the partial image 32 on another third piece 46 is connected with third piece 40 and/or second piece 24 and/or first piece 12 to create a unified contiguous image and theme.

By way of further explanation, interrelated form 10 is a multi-pieced, multi-sized form that utilizes a unified, contiguous theme of subject matter, pictures, graphics, colors or patterns for display on separate surfaces and around the corner 30 formed by the juncture of two surfaces. The juncture may form an acute or obtuse angle and be of varying degrees. The multiple separate pieces may or may not butt up to each other, or nearly so, but do not necessarily match up completely as shown in the figures. The contiguous theme or resultant image formed by the multiple partial images on each separate piece includes each separate piece such that the theme is consistent from all views. This feature is accomplished by including an image on the sides, top and bottom of the separate pieces as well as the front, such that the partial image on the side of one piece aligns or is consistent with the partial image on the front of one or more other pieces, for example only.

The separate pieces may be composed of images made of stretched canvas paintings, photo or computer enhanced prints, fabric, yarn, clay, metal, wire, plastic or a combination of these or any other media now known or hereafter developed. The interrelated form 10 of the present invention provides the ability for a person to use the corners of a space, indoors or outdoors. The present invention can tell a story, depict a complete picture, show a progression of color or pattern and add a contiguous theme to a room in homes, offices, schools and other public and private buildings or open spaces.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. An interrelated form apparatus comprising:

a. a three dimensional first piece with a front and a side with an image on said front and said side;

b. a three dimensional second piece with a front and a side with an image on said front and said side; and c. a first surface joined with a second surface at an angle wherein said first piece is located on said first surface and said second piece is located on said second surface and the image on the front of one piece combines with the image on the side of another piece to create a unified image.

2. The apparatus of claim 1 further including a three dimensional third piece with a front and a side with an image on said front and said side wherein said third piece is located on one of said surfaces and the image on said third piece combines with at least one of said first piece and said second piece to create said unified image.

3. The apparatus of claim 2 wherein said image on said third piece combines with both said first piece and said second piece to create said unified image.

4. The apparatus of claim 1 further including a plurality of three dimensional third pieces with a front and a side with an image on said front and said side wherein said plurality of third pieces are located on one of said surfaces and the image on said plurality of third pieces combines with said first piece and said second piece to create said unified image.

5. The apparatus of claim 2 further including a third surface joined with at least one of said first surface and said second surface and said third piece is located on said third surface.

6. An interrelated form apparatus comprising:

a. a three dimensional first piece with a front, top, bottom and at least one side with a partial image on said front, top, bottom and at least one side;

b. a three dimensional second piece with a front, top, bottom and at least one side with a partial image on said front, top, bottom and at least one side; and c. a first surface joined with a second surface at an angle wherein said first piece is located on said first surface and said second piece is located on said second surface and the partial image on the front, top, bottom and at least one side of one piece combines with the partial image on the front, top, bottom and at least one side of another piece to create a unified image by the approximate alignment of at least one side of one piece with at least one of the following: front, top, bottom, and at least one side of another piece.

7. The apparatus of claim 6 wherein said partial image on the front, top, bottom and at least one side of one piece combines with the partial image on another piece to create a unified image along the front, top, bottom and at least one side.

8. The apparatus of claim 6 further including a three dimensional third piece with a front, top, bottom and at least one side with a partial image on said front, top, bottom and at least one side wherein said third piece is located on one of said surfaces and the partial image on said third piece combines with at least one of said first piece and said second piece to create said unified image.

9. The apparatus of claim 8 wherein said partial image on said third piece combines with both said first piece and said second piece to create said unified image.

10. The apparatus of claim 6 further including a plurality of three dimensional third pieces with a front, top, bottom and at least one side with a partial image on said front, top, bottom and at least one side wherein said plurality of third pieces are located on one of said surfaces and the partial image on said plurality of third pieces combines with said first piece and said second piece to create said unified image.

11. The apparatus of claim 8 further including a third surface joined with at least one of said first surface and said second surface and said third piece is located on said third surface.

12. The apparatus of claim 6 wherein said unified image is made of material selected from the group comprising: painted canvas, photographic prints, fabric, yarn, clay, metal and plastic.

13. The apparatus of claim 6 wherein said first piece and said second piece are rectangular in shape with a front, top, bottom, and two sides.

14. The apparatus of claim 6 wherein said first surface and said second surface are walls connected with each other at approximately ninety degrees.

15. The apparatus of claim 6 wherein said unified image is selected from the group consisting of: pictures, graphics, colors and patterns.

16. A method for creating an interrelated form comprising:

a. providing a three dimensional first piece with a front and a side with an image on said front and side, a three dimensional second piece with a front and a side with an image on said front and side and a first surface joined with a second surface at an angle; and b. locating said first piece on said first surface and said second piece on said second surface such that the image on the front of one piece combines with the image on the side of another piece to create a unified image.

17. The method of claim 16 further including providing a three dimensional third piece with a front and a side with an image on said front and side and locating said third piece on one of said surfaces such that the image on said third piece combines with at least one of said first piece and said second piece to create said unified image.

18. The method of claim 17 wherein locating said third piece causes said image on said third piece to combine with both said first piece and said second piece to create said unified image.

19. The method of claim 16 further including providing a plurality of three dimensional third pieces with a front and a side with an image on said front and side and locating said plurality of third pieces on one of said surfaces such that the image on said plurality of third pieces combines with said first piece and said second piece to create said unified image.

20. The method of claim 17 further including joining a third surface with at least one of said first surface and said second surface and locating said third piece on said third surface.

* * * * *

UNITED STATES PATENT AND TRADEMARK OFFICE

CERTIFICATE OF CORRECTION

PATENT NO. : 7,509,763 B1
APPLICATION NO. : 11/999833
DATED : March 31, 2009
INVENTOR(S) : Carole Lynn Alverson It is certified that error appears in the above-identified patent and that said Letters Patent is hereby corrected as shown below:

Col. 4, Line 23 reads "...a seashore 26 and..." and should read "...a seashore 36 and...".

Col. 4, Line 30 reads "26 flows from the front..." and should read "36 flows from the front...".

Signed and Sealed this

Thirtieth Day of June, 2009

JOHN DOLL
*Acting Director of the United States Patent and Trademark Office*